US010083563B2

(12) United States Patent
Yang

(10) Patent No.: US 10,083,563 B2
(45) Date of Patent: Sep. 25, 2018

(54) PAPER SHEET HANDLING APPARATUS

(71) Applicant: Masterwork Automodules Tech Corp. Ltd, Taipei (TW)

(72) Inventor: Wen-Fu Yang, Taipei (TW)

(73) Assignee: Masterwork Automodules Tech Corp. Ltd, Taipei (TW)

( * ) Notice: Subject to any disclaimer, the term of this patent is extended or adjusted under 35 U.S.C. 154(b) by 0 days.

(21) Appl. No.: 15/642,344

(22) Filed: Jul. 6, 2017

(65) Prior Publication Data

US 2018/0165907 A1 Jun. 14, 2018

(30) Foreign Application Priority Data

Dec. 8, 2016 (TW) ..... 105140557 A

(51) Int. Cl.
*G07D 11/00* (2006.01)
*G07F 19/00* (2006.01)
*B65H 83/00* (2006.01)

(52) U.S. Cl.
CPC ..... *G07D 11/0006* (2013.01); *B65H 83/00* (2013.01); *G07D 11/00* (2013.01); *G07D 11/0021* (2013.01); *G07D 11/0081* (2013.01); *G07F 19/00* (2013.01); *B65H 2701/1912* (2013.01)

(58) Field of Classification Search
CPC ..... B65H 83/00; B65H 2701/1912; G07D 11/0021; G07D 11/0006; G07D 11/0081
See application file for complete search history.

(56) References Cited

U.S. PATENT DOCUMENTS 5,593,149 A 1/1997 Kimura et al.
8,684,155 B2 4/2014 Mishra et al.
2003/0085510 A1* 5/2003 Abe ..... G07D 11/0006 271/171

(Continued)

FOREIGN PATENT DOCUMENTS

EP 0675465 10/1995
TW 201317943 5/2013
WO WO-2012168965 A1 * 12/2012 ..... B65H 29/62

OTHER PUBLICATIONS

"Search Report of Europe Counterpart Application", dated Apr. 6, 2018, p. 1-p. 7.

*Primary Examiner* — Patrick Cicchino
(74) *Attorney, Agent, or Firm* — JCIPRNET

(57) ABSTRACT

A paper sheet handling apparatus includes a paper sheet handling module and storage modules. Storage modules are sequentially connected to be adapted to the paper sheet handling module. Each storage module includes a paper sheet storage cassette, a holding module and a conveyance assembly. The paper sheet storage cassette stores a paper sheet. The holding module holds the paper sheet storage cassette. The holding module is detachably connected to the holding module of at least adjacent one of the storage modules. The conveyance assembly is detachably connected to the holding module. The paper sheet storage cassette and the paper sheet handling module are located at opposite sides of the conveyance assembly respectively. The conveyance assembly conveys the paper sheet between the paper sheet storage cassette and the paper sheet handling module. The number of the storage modules can be changed to be adapted to another paper sheet handling module.

11 Claims, 6 Drawing Sheets

(56) References Cited

U.S. PATENT DOCUMENTS

| | | | | |
|---|---|---|---|---|
| 2012/0255829 | A1* | 10/2012 | Togiya | B65H 1/266 194/206 |
| 2014/0190787 | A1* | 7/2014 | Fujita | G07D 11/0012 194/206 |
| 2014/0217669 | A1 | 8/2014 | Aoji et al. | |
| 2016/0110941 | A1* | 4/2016 | Ikeya | G07D 11/0084 194/206 |
| 2016/0167912 | A1* | 6/2016 | Jeong | B65H 1/266 271/3.14 |
| 2016/0314446 | A1 | 10/2016 | Kim et al. | |
| 2017/0249807 | A1* | 8/2017 | Kanbayashi | G07F 19/202 |
| 2017/0309133 | A1* | 10/2017 | Okamoto | G07F 19/202 |

* cited by examiner

PAPER SHEET HANDLING APPARATUS

CROSS-REFERENCE TO RELATED APPLICATION

This application claims the priority benefit of Taiwan application serial no. 105140557, filed on Dec. 8, 2016. The entirety of the above-mentioned patent application is hereby incorporated by reference herein and made a part of this specification.

BACKGROUND OF THE INVENTION

Field of the Invention

The invention relates to a paper sheet handling apparatus, and particularly relates to a paper sheet handling apparatus that has a plurality of storage modules.

Description of Related Art

As an automated teller machine is for users to deposit and withdraw banknotes, there must be a conveyance path provided inside the machine to convey the banknotes in response to various operations. To convey the banknotes to each of the different banknote cassettes inside the automated teller machine, a paper sheet handling module is thus provided on the banknote cassettes for serving this purpose.

In some automated teller machines, a single banknote conveyance path is provided on several banknote cassettes to convey banknotes between each banknote cassette and the paper sheet handling module. With such kind of design, since the number of the banknote cassette and the specification of the banknote conveyance path are fixed and unchangeable, the configuration can only be applied to specific types of paper sheet handling module. Consequently, it is an important issue in designing automated teller machines to enhance versatility of the banknote cassette and the banknote conveyance path.

SUMMARY OF THE INVENTION

The invention provides a paper sheet handling apparatus that has storage modules with good versatility.

The paper sheet handling apparatus includes a paper sheet handling module and a plurality of storage modules. The paper sheet handling module is adapted to handle and convey a paper sheet. The storage modules are sequentially connected to be adapted to the paper sheet handling module. Herein, each of the storage modules includes a paper sheet storage cassette, a holding module, and a conveyance assembly. The paper sheet storage cassette is adapted to store the paper sheet. The holding module holds the paper sheet storage cassette, wherein the holding module of each of the storage modules is detachably connected to the holding module of at least adjacent one of the storage modules. The conveyance assembly is detachably connected to the holding module. The paper sheet storage cassette and the paper sheet handling module are located at two opposite sides of the conveyance assembly respectively. The conveyance assembly is adapted to convey the paper sheet between the paper sheet storage cassette and the paper sheet handling module, wherein the number of the storage modules is changeable to be adapted to another paper sheet handling module.

In an embodiment, the paper sheet handling apparatus includes a plurality of first switching assemblies. The first switching assemblies are disposed on the conveyance assemblies respectively. Each of the first switching assemblies is adapted to operate in two different states to open a conveyance path between corresponding one of the conveyance assemblies and the paper sheet handling module, or to open a conveyance path between the conveyance assemblies.

In an embodiment, each of the storage modules includes a first driving component disposed on the holding module and adapted to drive a main conveyance path of the paper sheet handling apparatus to convey the paper sheet between the conveyance assembly and the paper sheet storage cassette.

In an embodiment, each of the storage modules includes a supporting plate and a second driving component. The supporting plate is disposed in the paper sheet storage cassette and adapted to support the paper sheet. The second driving component is disposed on the holding module and adapted to drive the supporting plate up and down in accordance with the number of the paper sheet on the supporting plate.

In an embodiment, the paper sheet handling apparatus includes a containing structure and a slide rail assembly. Herein, the slide rail assembly is connected between the containing structure and the storage modules, and the storage modules are adapted to be moved in and out of the containing structure by the slide rail assembly.

In an embodiment, each of the conveyance assemblies has two connecting ends that are opposite to each other. At least one of the connecting ends of each of the conveyance assemblies is adjacent to at least one of the connecting ends of at least another one of the conveyance assemblies.

In an embodiment, the paper sheet handling apparatus includes a discrimination module disposed inside the paper sheet handling module and adapted to discriminate the paper sheet.

In an embodiment, the paper sheet handling apparatus includes at least one second switching assembly, wherein the at least one second switching assembly is disposed between two of the conveyance assemblies. The at least one second switching assembly is adapted to operate in three different states so as to open a conveyance path between the two of the conveyance assemblies, or to open a conveyance path between one of the two of the conveyance assemblies and the paper sheet handling module, or to open a conveyance path between the other one of the two of conveyance assemblies and the paper sheet handling module.

In an embodiment, each of the storage modules includes a first driving component disposed on the holding module and adapted to drive a main conveyance path of the paper sheet handling apparatus to convey the paper sheet between the conveyance assembly and the paper sheet storage cassette.

In an embodiment, each of the storage modules includes a supporting plate and a second driving component. The supporting plate is disposed in the paper sheet storage cassette and adapted to support the paper sheet. The second driving component is disposed on the holding module and adapted to drive the supporting plate up and down in accordance with the number of the paper sheet on the supporting plate.

In an embodiment, the paper sheet handling apparatus includes a containing structure and a slide rail assembly. Herein, the slide rail assembly is connected between the containing structure and the storage modules, and the storage modules are adapted to be moved in and out of the containing structure by the slide rail assembly.

In an embodiment, each of the conveyance assemblies has two connecting ends that are opposite to each other. At least one of the connecting ends of each of the conveyance assemblies is adjacent to at least one of the connecting ends of at least another one of the conveyance assemblies.

In an embodiment, the paper sheet handling apparatus includes a discrimination module disposed inside the paper sheet handling module and adapted to discriminate the paper sheet.

Based on the above, the paper sheet handling apparatus includes a plurality of storage modules. The holding modules of the storage modules are detachably connected to each other, and the holding module of each storage module is detachably connected to the corresponding holding module. By the detachable feature of the holding module and the conveyance assembly, the number of the storage modules may be increased or decreased as desired, and the type of the conveyance assembly may also be changed as desired to be adapted to a variety of paper handling modules of different forms, so as to enhance versatility of the paper sheet handling apparatus.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments and, together with the description, serve to explain the principles of the invention.

DESCRIPTION OF THE EMBODIMENTS

Figure 1:
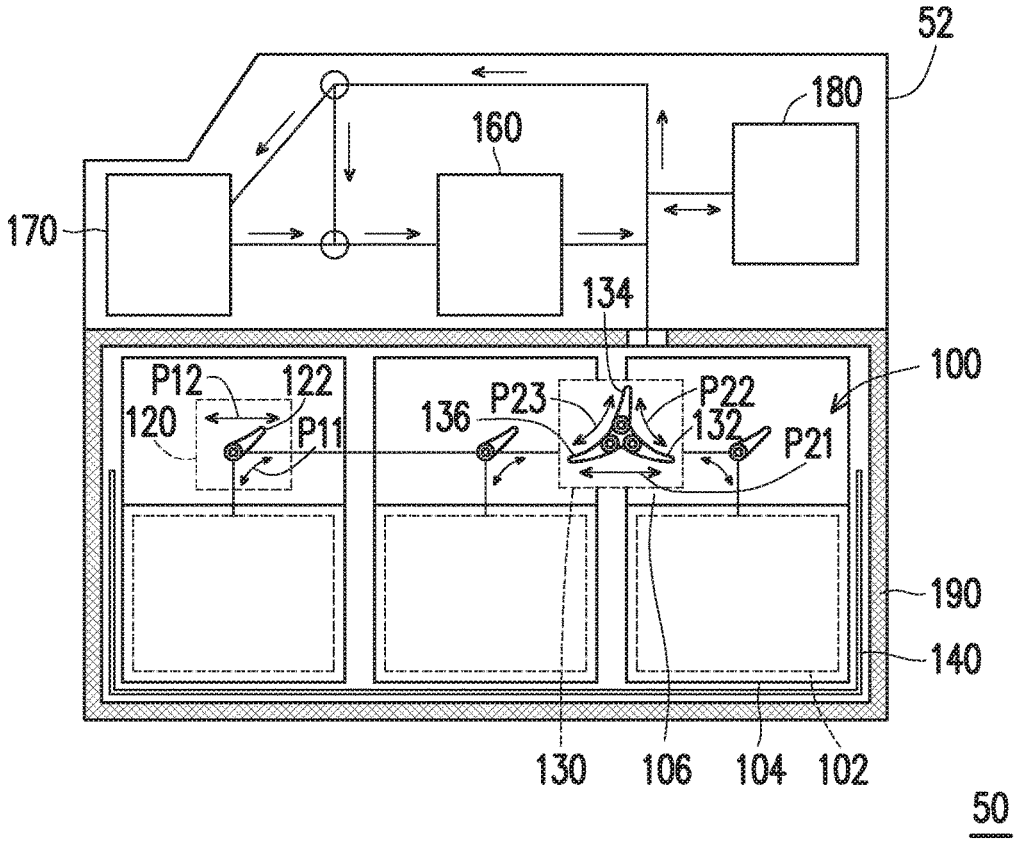
FIG. 1 is a schematic view of a paper sheet handling apparatus according to an embodiment.
Figure 2:
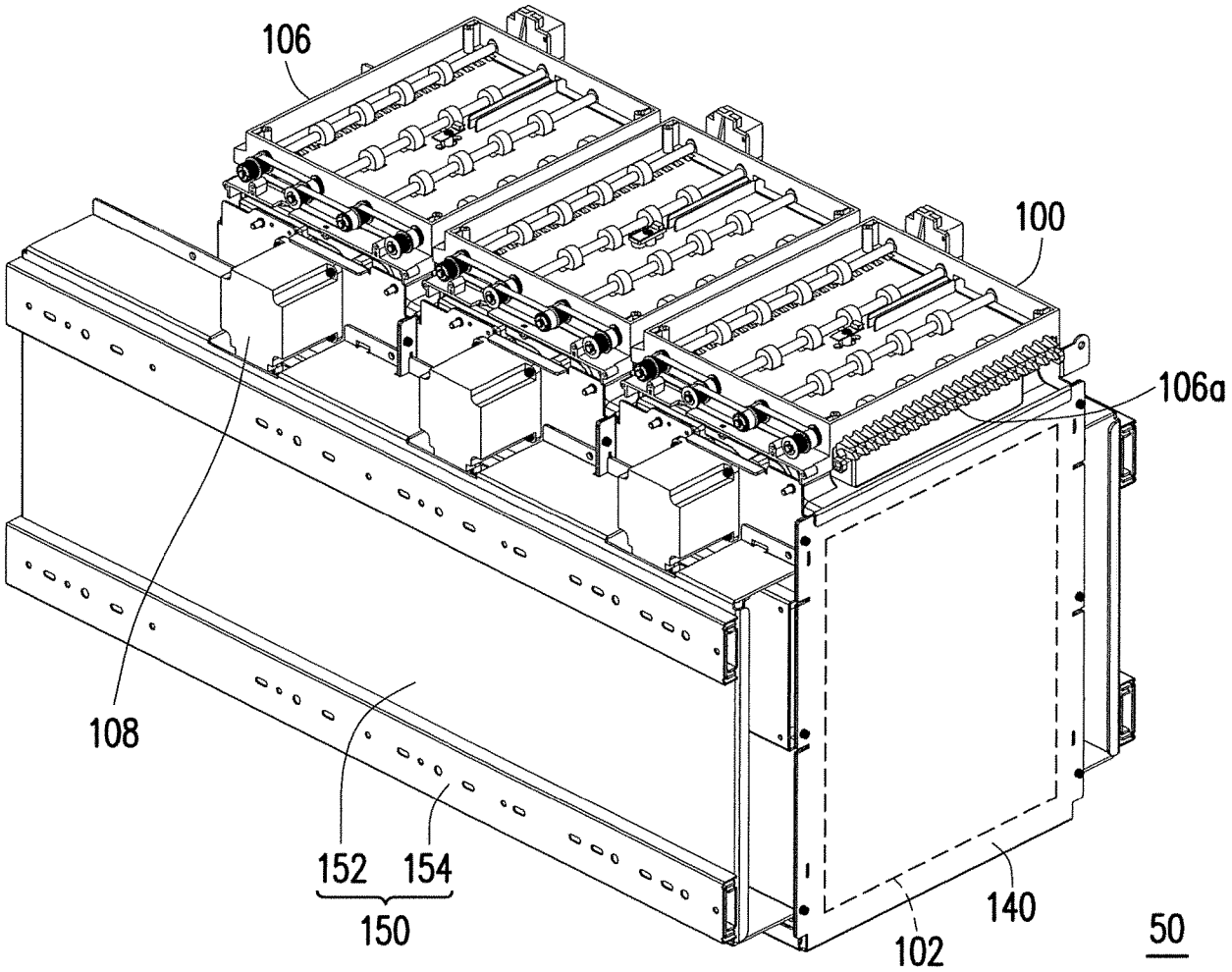
FIG. 2 is a perspective view of some components of the paper sheet handling apparatus of FIG. 1.

FIG. 1 is a schematic view of a paper sheet handling apparatus according to an embodiment. FIG. 2 is a perspective view of some components of the paper sheet handling apparatus of FIG. 1. With reference to FIG. 1 and FIG. 2, in this embodiment, a paper sheet handling apparatus 50 includes a paper sheet handling module 52 and a plurality of storage modules 100. The storage modules 100 are disposed inside a housing 190, and the paper sheet handling module 52 is disposed above the housing 190. The housing 190 is, for example, a safe. The paper sheet handling module 52 is adapted to convey a paper sheet (not shown). The paper sheet is, for example, a banknote, a check or other suitable paper sheets, and the invention is not limited thereto. The storage modules 100 are sequentially connected to be adapted to the paper sheet handling module 52. Herein, each storage module 100 includes a paper sheet storage cassette 102, a holding module 104, and a conveyance assembly 106. The paper sheet storage cassette 102 is adapted to store the paper sheet. The holding module 104 holds the paper sheet storage cassette 102, and the holding module 104 of each storage module 100 is detachably connected to the adjacent holding module 104 of at least another one of the storage modules 100. Specifically, the paper sheet storage cassette 102 is placed inside the holding module 104, and the holding modules 104 are connected to each other in a row, as shown in FIG. 2. In this embodiment, the paper sheet storage cassettes 102 all have the same size, for example, so as to facilitate mass production, but the invention is not limited thereto.

The conveyance assembly 106 is detachably connected to the holding module 104. Herein, the paper sheet storage cassette 102 and the paper sheet handling module 52 are located at two opposite sides of the conveyance assembly 106 respectively, and the conveyance assembly 106 is adapted to convey the paper sheet between the paper sheet storage cassette 102 and the paper sheet handling module 52. In other words, the conveyance assembly 106 may be assembled to the holding module 104 and cover the paper sheet storage cassette 102 located inside the holding module 104. Consequently, during the conveyance of the paper sheet, the paper sheet is conveyed to the conveyance assembly 106 through the paper sheet handling module 52, and the conveyance assembly 106 then conveys the paper sheet to the paper sheet storage cassette 102 inside the holding module 104. In addition, the direction of conveying the paper sheet may be two-way, so that the paper sheet may be conveyed from the paper sheet storage cassette 102 inside the holding module 104 to the conveyance assembly 106, and may be conveyed to the paper sheet handling module 52 through the conveyance assembly 106. In this embodiment, each conveyance assembly 106 has two connecting ends **106*a* that are opposite to each other, and at least one connecting end 106*a* of each conveyance assembly 106 is adjacent to at least one connecting end 106*a* of at least another one of the conveyance assemblies 106. In this embodiment, the conveyance assemblies 106** all have the same size, for example, so as to facilitate mass production, but the invention is not limited thereto.

As described above, the holding modules 104 of the storage modules 100 are detachably connected to each other, and the conveyance assembly 106 of each storage module 100 is detachably connected to the corresponding holding module 104. By the detachable feature of the holding module 104 and the conveyance assembly 106, the number of the storage modules 100 may be increased or decreased as desired. The type of the conveyance assembly 106 may also be changed as desired to be adapted to a variety of paper handling modules 52 of different specifications so as to enhance versatility of the paper sheet handling apparatus.

Figure 3:
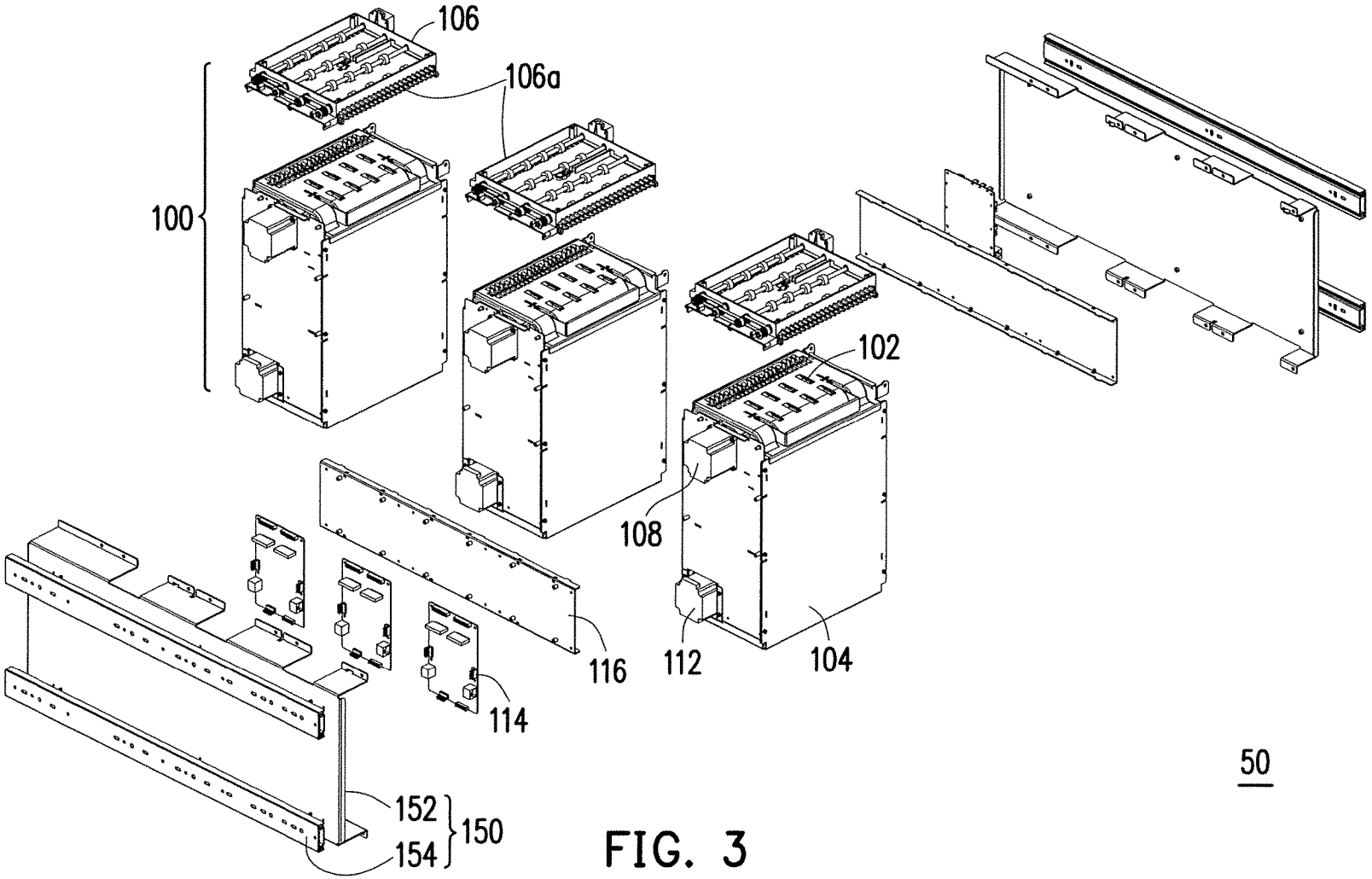
FIG. 3 is an exploded view of the paper sheet handling apparatus of FIG. 2.

FIG. 3 is an exploded view of the paper sheet handling apparatus of FIG. 2. With reference to FIG. 2 and FIG. 3, in this embodiment, the storage module 100 further includes a first driving component 108. The first driving component 108 is disposed on the holding module 104 and is adapted to drive a main conveyance path of the paper sheet handling apparatus 50 to convey the paper sheet between the conveyance assembly 106 and the paper sheet storage cassette 102. The first driving component 108 is, for example, a motor. Specifically, during the conveyance of the paper sheet, the paper sheet is conveyed through the first driving component 108 from the paper sheet storage cassette 102 to the conveyance assembly 106 or from the conveyance assembly 106 to the paper sheet storage cassette 102.

Figure 4:
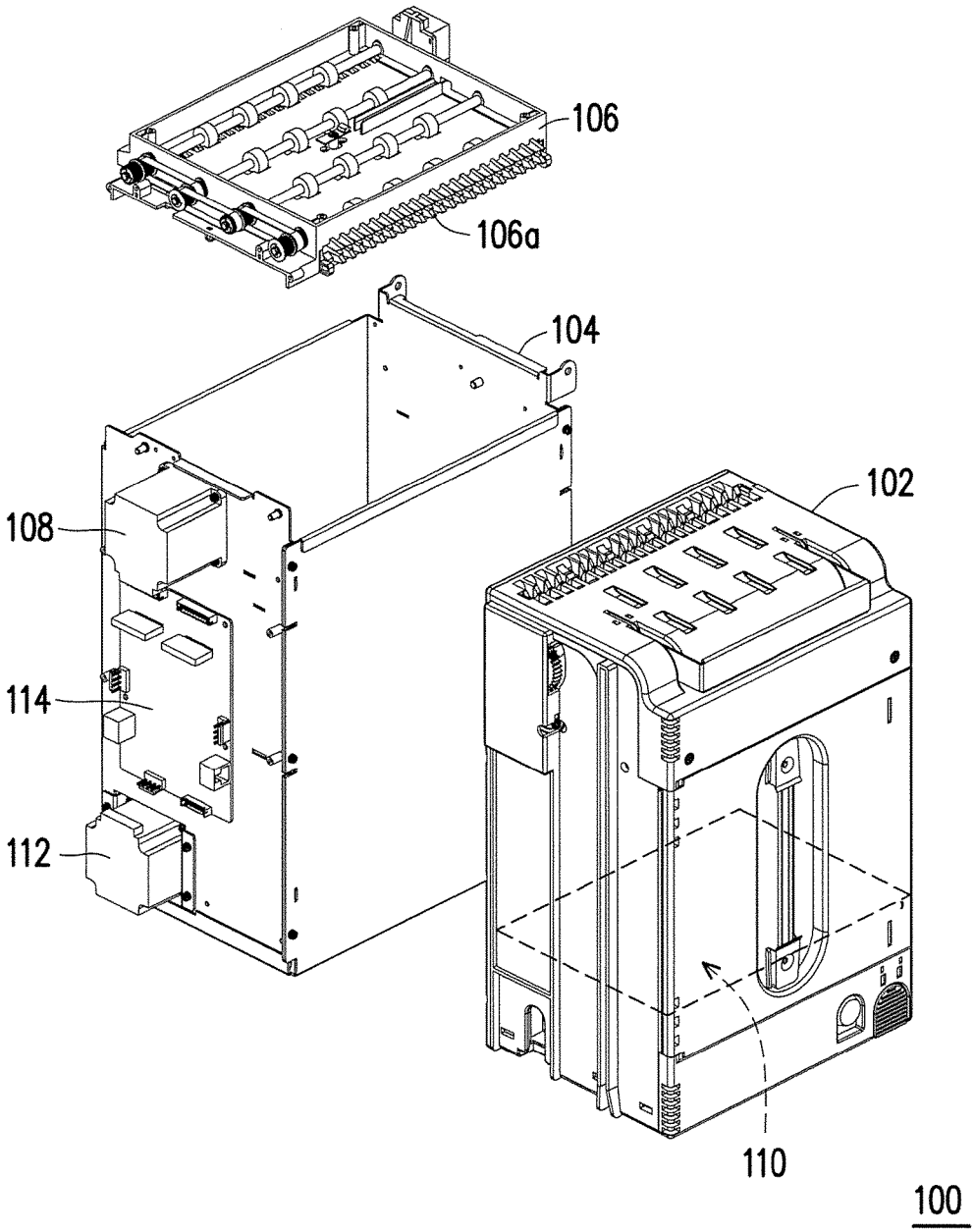
FIG. 4 is an exploded view of the storage module of FIG. 3.

FIG. 4 is an exploded view of the storage module of FIG. 3. With reference to FIG. 3 and FIG. 4, in this embodiment, the storage module 100 further includes a supporting plate 110 and a second driving component 112. The supporting plate 110 is disposed in the paper sheet storage cassette 102 and is adapted to support the paper sheet. The second driving component 112 is disposed on the holding module 104 and is adapted to drive the supporting plate 110 up and down in accordance with the number of the paper sheet on the supporting plate 110. The second driving component 112 is, for example, a motor. Specifically, during the conveyance of the paper sheet, the paper sheet is conveyed through the conveyance assembly 106 to the paper sheet storage cassette 102 inside the holding module 104, and then falls on the supporting plate 110 in the paper sheet storage cassette 102. When the number of the paper sheet on the supporting plate 110 increases, the second driving component 112 drives the supporting plate 110 to descend so as to support more paper sheets. When the number of the paper sheet on the supporting plate 110 decreases, the second driving component 112 drives the supporting plate 110 to ascend so that the conveyance assembly 106 may convey the remaining paper sheets on the supporting plate 110 more conveniently.

In this embodiment, the storage module 100 further includes a circuit board 114 and a circuit board support 116. The circuit board 114 may be disposed on the holding module 104 and electrically connected to the paper sheet storage cassette 102, the first driving component 108 and the second driving component 112, as shown in FIG. 4. The circuit board support 116 may be disposed on the storage module 100 for securing the circuit board 114.

With reference to FIG. 1 to FIG. 3, in this embodiment, the paper sheet handling apparatus 50 further includes a containing structure 140 and a slide rail assembly 150. Herein, the slide rail assembly 150 is connected between the containing structure 140 and the storage modules 100, and the storage modules 100 are adapted to be moved in and out of the containing structure 140 by the slide rail assembly 150. Specifically, the slide rail assembly 150 includes a paper sheet storage cassette support 152 and a slide rail 154. The paper sheet storage cassette support 152 is adapted to be connected to a side wall of the storage module 100. The slide rail 154 is connected between the paper sheet storage cassette support 152 and the containing structure 140. Since the paper sheet storage cassette support 152 is disposed on the storage module 100, the storage modules 100 may be moved in or out of the containing structure 140 by the operation of the slide rail 154, so that the storage modules 100 may be conveniently removed from the paper sheet handling apparatus 50 for subsequent action, such as changing the configuration mode of the storage modules 100 or performing maintenance.

With reference to FIG. 1 again, the paper sheet (such as a banknote) in the paper sheet handling apparatus 50 is, for example, conveyed by the above-mentioned main conveyance path including at least parts of the conveyance paths following the arrow direction as shown in FIG. 1 so that operations of entering, withdrawing, detecting and storing the banknote are carried out. In this embodiment, the paper sheet handling apparatus 50 further includes a discrimination module 160 that is disposed inside the paper sheet handling module 52 and adapted to discriminate the paper sheet. The discrimination module 160 is, for example, a banknote detector module. In addition, in this embodiment, the paper sheet handling apparatus 50 further includes an inlet/outlet port 170 and a temporary holding section 180. The inlet/outlet port 170, for example, is for entering the banknote in and removing the banknote out of the paper sheet handling apparatus 50. The temporary holding section 180, for example, is for storing the banknote temporarily. Therefore, the paper sheet handling module 52 may convey the paper sheet to any conveyance path in the paper sheet handling module 52. Along these conveyance paths, the paper sheet, under the control of the paper sheet handling apparatus 50, may be conveyed from the inlet/outlet port 170 to the discrimination module 160, and then conveyed to the temporary holding section 180 or the storage module 100. In addition, the paper sheet, under the control of the paper sheet handling apparatus 50, may be conveyed from the storage module 100 to the temporary holding section 180 or the inlet/outlet port 170. The conveyance path that goes through the discrimination module 160 as shown in FIG. 1 is one-way, but it may also be two-way. The invention is not limited thereto.

In this embodiment, the paper sheet handling apparatus 50 further includes a plurality of first switching assemblies 120. Herein, the first switching assemblies 120 are disposed on the conveyance assemblies 106 respectively. Each of the first switching assemblies 120 is adapted to operate in two different states either to open a conveyance path P11 between the corresponding conveyance assembly 106 and the paper sheet handling module 52, or to open a conveyance path P12 between the conveyance assemblies 106. Specifically, the first switching assembly 120 includes a solenoid 122. When the solenoid 122 blocks the conveyance path P12, the first switching assembly 120 is in the state of opening the conveyance path P11 and guides the paper sheet to move in two-way direction on the conveyance path P11. When the solenoid 122 blocks the conveyance path P11, the first switching assembly 120 is in the state of opening the conveyance path P12 and guides the paper sheet to move in two-way direction on the conveyance path P12. Consequently, the paper sheet handling apparatus 50 may be switched to different conveying states by the first switching assembly 120 to achieve a good conveying function.

In this embodiment, the paper sheet handling apparatus 50 further includes at least one second switching assembly 130. Herein, the second switching assembly 130 is disposed between two adjacent conveyance assemblies 106. The second switching assembly 130 is adapted to operate in three different states so as to open a conveyance path P21 between the two conveyance assemblies 106, or to open a conveyance path P22 between one of the two conveyance assemblies 106 and the paper sheet handling module 52, or to open a conveyance path P23 between the other one of the conveyance assemblies 106 and the paper sheet handling module 52. Specifically, the second switching assembly 130 includes a first solenoid 132, a second solenoid 134 and a third solenoid 136. When the first solenoid 132 blocks the conveyance path P22 and the third solenoid 136 blocks the conveyance path P23, the second switching assembly 130 is in the state of opening the conveyance path P21 and guides the paper sheet to move in two-way direction on the conveyance path P21. When the first solenoid 132 blocks the conveyance path P21 and the second solenoid 134 blocks the conveyance path P23, the second switching assembly 130 is in the state of opening the conveyance path P22 and guides the paper sheet to move in two-way direction on the conveyance path P22. When the third solenoid 136 blocks the conveyance path P21 and the second solenoid 134 blocks the conveyance path P22, the second switching assembly 130 is in the state of opening the conveyance path P23 and guides the paper sheet to move in two-way direction on the conveyance path P23. Consequently, the paper sheet handling apparatus 50 may be switched to different conveying states by the second switching assembly 130 to achieve a good conveying function.

Figure 5:
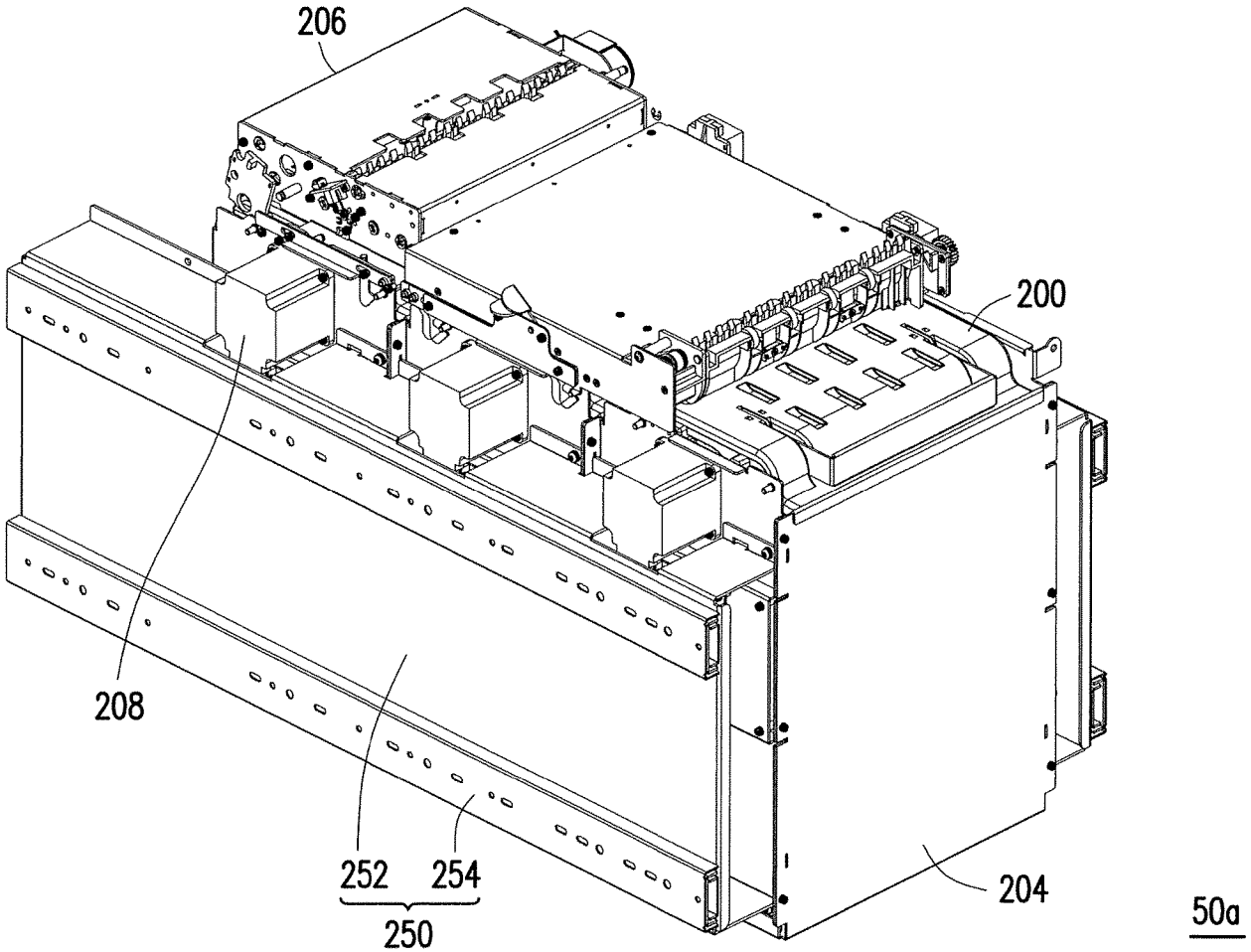
FIG. 5 is a perspective view of some components of a paper sheet handling apparatus according to another embodiment.
Figure 6:
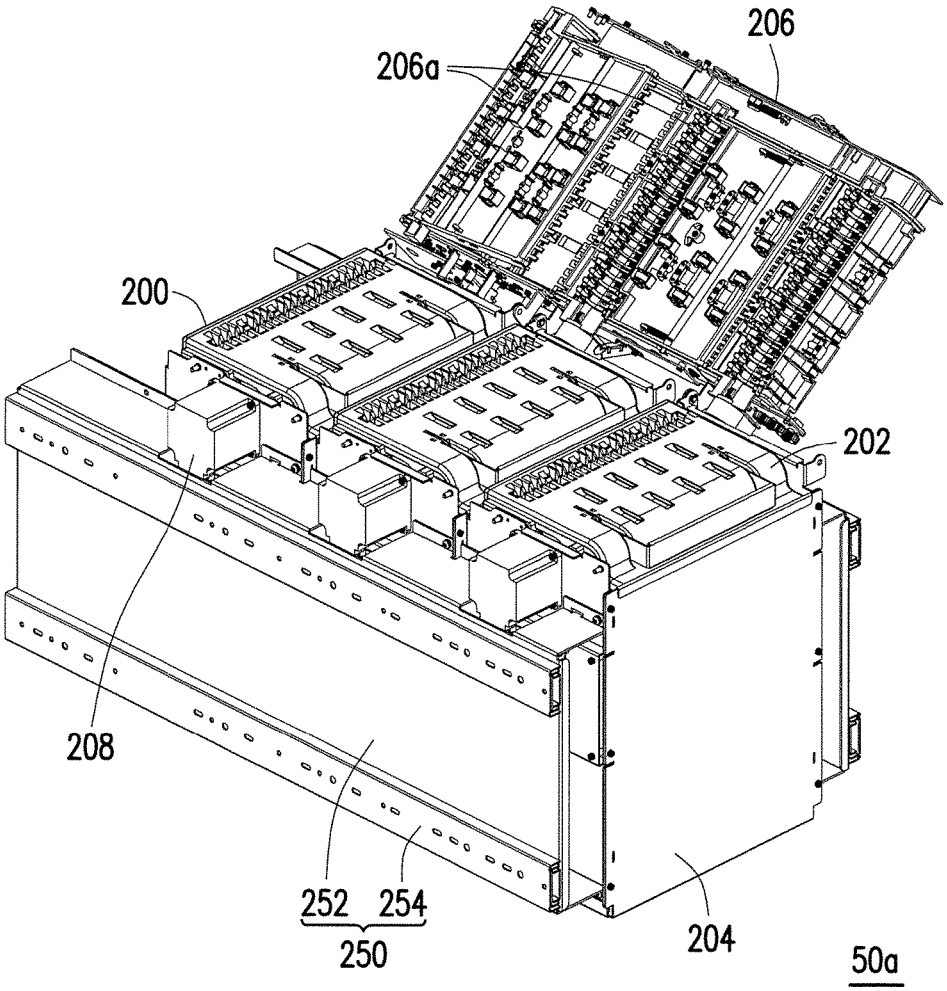
FIG. 6 shows the conveyance assembly of FIG. 5 unfolding from the paper sheet storage cassette.

FIG. 5 is a perspective view of some components of a paper sheet handling apparatus according to another embodiment. FIG. 6 shows the conveyance assembly of FIG. 5 unfolding from the paper sheet storage cassette. With reference to FIG. 5 to FIG. 6, a holding module 204, a first driving component 208, a slide rail assembly 250, a paper sheet storage cassette support 252 and a slide rail 254 in FIG. 5 are similar in configuration and operation methods to the holding module 104, the first driving component 108, the slide rail assembly 150, the paper sheet storage cassette support 152 and the slide rail 154 in FIG. 2, and repeated description is omitted here. The distinction between a paper sheet handling apparatus 50*a* and the paper sheet handling apparatus 50 lies in the fact that the specification of the conveyance assembly 206 as shown in FIG. 5 and FIG. 6 is different from the specification of the conveyance assembly 106 as shown in FIG. 2 so that the paper sheet handling apparatus 50*a* is adapted to other paper sheet handling modules of different types or different specifications. Similar to the paper sheet handling apparatus 50 as shown in FIG. 2, the conveyance assemblies 206 are each detachably connected to each other by two opposite connecting ends 206*a* on the conveyance assembly 206. As shown in FIG. 6, the conveyance assembly 206 of this embodiment may unfold from the paper sheet storage cassette 202 to facilitate adjustment or maintenance.

In summary, the paper sheet handling apparatus includes a plurality of storage modules. The holding modules of the storage modules are detachably connected to each other, and the holding module of each storage module is detachably connected to the corresponding holding module. By the detachable feature of the holding module and the conveyance assembly, the number of the storage modules may be increased or decreased as desired, and the type of the conveyance assembly may also be changed as desired to be adapted to a variety of paper handling modules of different forms so as to enhance versatility thereof.

Although the embodiments are already disclosed as above, these embodiments should not be construed as limitations on the scope of the invention. It will be apparent to those skilled in the art that various modifications and variations can be made to the disclosed embodiments without departing from the scope or spirit of this invention. In view of the foregoing, it is intended that the invention covers modifications and variations provided that they fall within the scope of the following claims and their equivalents.

What is claimed is:

1. A paper sheet handling apparatus, comprising:

a paper sheet handling module adapted to handle and convey a paper sheet; and a plurality of storage modules sequentially connected to be adapted to the paper sheet handling module, wherein each of the storage modules comprises:

a paper sheet storage cassette adapted to store the paper sheet;

a holding module holding the paper sheet storage cassette, wherein the holding module of each of the storage modules is detachably connected to the holding module of at least adjacent one of the storage modules; and a conveyance assembly detachably connected to the holding module, wherein the paper sheet storage cassette and the paper sheet handling module are located at two opposite sides of the conveyance assembly respectively, and the conveyance assembly is adapted to convey the paper sheet between the paper sheet storage cassette and the paper sheet handling module, wherein the number of the storage modules is changeable to be adapted to another paper sheet handling module, wherein each of the conveyance assemblies has two connecting ends opposite to each other, and at least one of the connecting ends of each of the conveyance assemblies is adjacent to at least one of the connecting ends of at least another one of the conveyance assemblies, and the conveyance assemblies are each detachably connected to each other by the connecting ends.

2. The paper sheet handling apparatus as recited in claim 1, further comprising a plurality of first switching assemblies, wherein the first switching assemblies are disposed on the conveyance assemblies respectively, and each of the first switching assemblies is adapted to operate in two different states to open a conveyance path between corresponding one of the conveyance assemblies and the paper sheet handling module, or to open a conveyance path between the conveyance assemblies.

3. The paper sheet handling apparatus as recited in claim 2, wherein each of the storage modules comprises a first driving component disposed on the holding module and adapted to drive a main conveyance path of the paper sheet handling apparatus to convey the paper sheet between the conveyance assembly and the paper sheet storage cassette.

4. The paper sheet handling apparatus as recited in claim 2, wherein each of the storage modules comprises:

a supporting plate disposed in the paper sheet storage cassette and adapted to support the paper sheet; and a second driving component disposed on the holding module and adapted to drive the supporting plate up and down in accordance with the number of the paper sheet on the supporting plate.

5. The paper sheet handling apparatus as recited in claim 2, further comprising a containing structure and a slide rail assembly, wherein the slide rail assembly is connected between the containing structure and the storage modules, and the storage modules are adapted to be moved in and out of the containing structure by the slide rail assembly.

6. The paper sheet handling apparatus as recited in claim 2, further comprising a discrimination module disposed inside the paper sheet handling module and adapted to discriminate the paper sheet.

7. The paper sheet handling apparatus as recited in claim 1, further comprising at least one second switching assembly, wherein the at least one second switching assembly is disposed between two of the conveyance assemblies, and the at least one second switching assembly is adapted to operate in three different states so as to open a conveyance path between the two of the conveyance assemblies, to open a conveyance path between one of the two of the conveyance assemblies and the paper sheet handling module, or to open a conveyance path between the other one of the two of conveyance assemblies and the paper sheet handling module.

8. The paper sheet handling apparatus as recited in claim 7, wherein each of the storage modules comprises a first driving component disposed on the holding module and adapted to drive a main conveyance path of the paper sheet handling apparatus to convey the paper sheet between the conveyance assembly and the paper sheet storage cassette.

9. The paper sheet handling apparatus as recited in claim 7, wherein each of the storage modules comprises:

a supporting plate disposed in the paper sheet storage cassette and adapted to support the paper sheet; and a second driving component disposed on the holding module and adapted to drive the supporting plate up and down in accordance with the number of the paper sheet on the supporting plate.

10. The paper sheet handling apparatus as recited in claim 7, further comprising a containing structure and a slide rail assembly, wherein the slide rail assembly is connected between the containing structure and the storage modules, and the storage modules are adapted to be moved in and out of the containing structure by the slide rail assembly.

11. The paper sheet handling apparatus as recited in claim 7, further comprising a discrimination module disposed inside the paper sheet handling module and adapted to discriminate the paper sheet.

* * * * *